US010167059B2

(12) United States Patent
Askestad

(10) Patent No.: US 10,167,059 B2
(45) Date of Patent: Jan. 1, 2019

(54) CHAIN STOPPER

(71) Applicant: National Oilwell Varco Norway AS, Kristiansand S (NO)

(72) Inventor: Sigmund Askestad, Tvedestrand (NO)

(73) Assignee: NATIONAL OILWELL VARCO NORWAY AS, Kristiansand S (NO)

( * ) Notice: Subject to any disclaimer, the term of this patent is extended or adjusted under 35 U.S.C. 154(b) by 0 days.

(21) Appl. No.: 15/523,213

(22) PCT Filed: Oct. 31, 2014

(86) PCT No.: PCT/NO2014/050208
§ 371 (c)(1),
(2) Date: Apr. 28, 2017

(87) PCT Pub. No.: WO2016/068717
PCT Pub. Date: May 6, 2016

(65) Prior Publication Data

US 2017/0313388 A1 Nov. 2, 2017

(51) Int. Cl.
*B63B 21/18* (2006.01)

(52) U.S. Cl.
CPC ..... *B63B 21/18* (2013.01)

(58) Field of Classification Search
CPC ..... B63B 21/18
See application file for complete search history.

(56) References Cited

U.S. PATENT DOCUMENTS

| | | | | |
|---|---|---|---|---|
| 2,919,671 | A | 1/1960 | Knapp et al. | |
| 6,425,339 | B1 | 7/2002 | Furlong et al. | |
| 2015/0090171 | A1* | 4/2015 | Dang | B63B 21/18 114/230.29 |

FOREIGN PATENT DOCUMENTS

| | | | |
|---|---|---|---|
| FR | 2601322 | A1 | 1/1988 |
| GB | 651398 | A | 4/1951 |

OTHER PUBLICATIONS

International Patent Application No. PCT/NO2014/050208 International Search Report and Written Opinion dated Jun. 29, 2015 (9 pages).

* cited by examiner

*Primary Examiner* — Stephen P Avila
(74) *Attorney, Agent, or Firm* — Conley Rose, P.C.

(57) ABSTRACT

A chain stopper is connectable to a support structure, such as a platform, and comprises: a chain locking portion for automatically engaging a first chain link of a chain so as to prevent the chain from being pulled in a first direction and; an activation portion connected to the chain locking portion. The activation portion is configured such that, upon pulling the chain in a second direction, the activation portion is adapted to be engaged by the chain so as to disengage the chain locking portion from the first chain link, allowing the chain to be pulled in the second direction.

14 Claims, 11 Drawing Sheets

CHAIN STOPPER

CROSS REFERENCE TO RELATED APPLICATIONS

This application is a 35 U.S.C. § 371 national stage application of PCT/NO2014/050208 filed Oct. 31, 2014, incorporated herein by reference in its entirety for all purposes.

FIELD OF THE DISCLOSURE

This disclosure relates to a chain stopper. More specifically the disclosure relates to a chain stopper being connectable to a support structure and comprising a chain locking portion for engaging a first chain link of a chain so as to prevent the chain from being pulled in a first direction, while allowing the chain to be pulled in a second direction. The disclosure also relates to a chain stopper assembly including the chain stopper.

BACKGROUND

Chain stoppers are commonly used in offshore mooring applications, such as for termination of mooring lines and hawsers to floating units and vessels. A chain stopper is usually used together with a mooring winch for unloading the mooring winch during regular operations. This is beneficial for the winch as well as for the chain itself.

Chain stoppers are usually operated manually, either directly or indirectly. Indirectly means by manually operating equipment, such as hydraulic equipment, adapted to engage a locking function for locking the chain by means of the chain stopper. Most chain stoppers are provided above sea level, typically on a vessel or floating unit which is being moored. This implies that chains are running over bends, such as in fairleads or bending shoes, under high tension, which is undesirable due to wear and fatigue of the chain. The fatigue problem is particularly pronounced in mooring of permanent offshore structures, as the same or a few chain links are constantly being subject to considerable stresses and wear. It is a further drawback of the prior art chain stoppers that the part or portion of the chain stopper engaging one or more chain links is not adapted to handle forces acting on the chain in a gentle way, thus contributing to increased wear.

A few known chain stoppers are semi-automatic, in that the chain stoppers may automatically engage the chain as soon as the tension from the winch is being reduced or is coming to a stop. Such semi-automatic chain stoppers typically use a pin or other stopping means biased by means of springs, or the like, in order to engage the chain. The semi-automatic chain stoppers tend to be rather complicated in use and not as reliable as is typically required in offshore mooring applications. The semi-automatic stoppers also tend to induce a lot of additional stresses and wear on the chain links being engaged.

SUMMARY OF THE DISCLOSED EXEMPLARY EMBODIMENTS

In a first aspect, the disclosure relates to a chain stopper being connectable to a support structure and comprising:

a chain locking portion for automatically engaging a first chain link of a chain so as to prevent the chain from being pulled in a first direction, wherein said chain stopper further comprises:

an activation portion connected to said chain locking portion, said activation portion, upon pulling said chain in a second direction, being adapted to be engaged by said chain so as to disengage said chain locking portion from said first chain link allowing said chain to be pulled in said second direction.

The support structure may typically be a structure that is to be moored, such as a vessel, a turret mooring table or another floating structure.

In a second aspect the disclosure relates to a chain stopper assembly comprising a chain stopper according to the first aspect of the disclosure, said chain stopper assembly being connectable to a support structure, and wherein said chain stopper assembly further comprises:

a suspension structure to which the chain stopper is connected. The chain stopper may be connectable to the support structure by via the suspension structure.

BRIEF DESCRIPTION OF THE DRAWINGS

In the following is described exemplary embodiments illustrated in the accompanying drawings, wherein.

DETAILED DESCRIPTION OF THE DISCLOSED EXEMPLARY EMBODIMENTS

Figure 1:
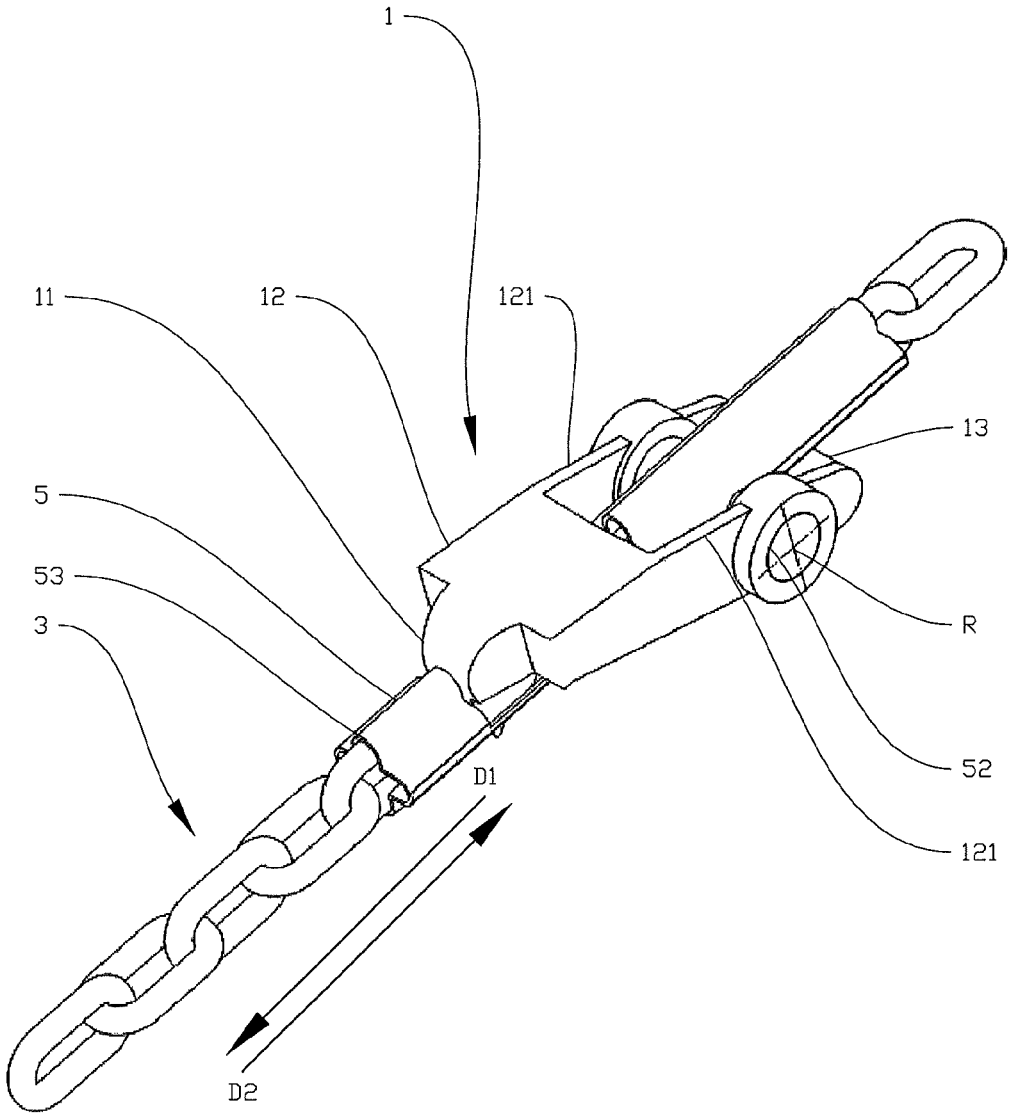
FIG. 1 shows, in a perspective view, a chain stopper according to the present disclosure.

The embodiments disclosed herein are provided to remedy or to reduce at least one of the drawbacks of the prior art, or at least provide a useful alternative to prior art.

The chain stopper according to the disclosure is of the semi-automatic type. The chain locking portion of the chain stopper prevents the chain from being pulled in one direction, while an activation portion of the chain stopper may be engaged by the chain itself so as to free the locking portion from the first chain link and thereby allowing the chain to be pulled in another direction. It is the movement of the chain itself that initiates the unlocking operation. Without the activation portion, the chain locking portion would also prevent the chain from being pulled in the second direction.

Upstream and downstream will in the following be used to describe the entrance and exit sides, respectively, of the chain in the chain stopper when the chain is being pulled in, that is in the second direction.

In use it may be necessary to re-tension chains from time-to-time. This may be due to drifting anchors on the seabed or due to stretching and extending fibre ropes, to which the chain is connected, in total constituting a mooring line. Therefore it may be of great value to be able to tension the chain without having to rely on manual work. After having tensioned the chain, typically by means of a winch, by pulling the chain in what corresponds to the second direction mentioned above, the chain locking portion of the chain stopper will again automatically engage a new first chain link so as to prevent the chain from being de-tensioned. This also implies that the chain stopper according to the disclosure may be provided below sea level and thus upstream of any bend on the chain.

In one embodiment the activation portion and the chain locking portion of said chain stopper may be connected by a connection body, implying that the chain locking portion and the activation portion may be provided at a distance from each other. This arrangement may have several advantages that will be explained in the following. For instance, it may be possible to optimize the chain locking portion for load distribution considerations whereas it at the same time may be possible to optimize the activation portion for the task of deactivating the chain locking portion in a gentle way without unnecessary wear on the chain stopper and on the chain. The chain locking portion, the connecting body and the activation portion, may be different parts of one unit, or the chain locking portion and the activation portion may be different parts of the chain stopper that are mechanically connected to each other via the connecting body.

In one embodiment, the chain locking portion may include a claw complementarily fitting to at least a part of a curved portion of said first chain link. By forming the claw so as to fit around at least a part of a curved end portion of said first chain link, the chain stopper may be adapted to absorb forces acting on the chain in a gentle, efficient way with little wear on the chain as well as on the chain stopper itself. In one particularly useful embodiment said claw may be adapted to substantially cover more than half of said curved end portion of said first chain link or even to substantially cover the whole curved end portion, whereby wear and additional stresses on the chain and on the chain stopper may be significantly reduced while at the same time ensuring a reliable locking function.

In one embodiment a tip of said claw may be formed with a recess for allowing a chain link to glide therethrough. This may be particularly useful in an embodiment where the claw is to be lifted out of engagement with said first chain link in order to pull the chain in said second direction, whereby the claw does not have to be lifted the full height of a chain link in order for a consecutive chain link of the same orientation, for instance a consecutive standing chain link, to pass under the tip. The advantage of this embodiment will be better understood with reference to the drawings and the appurtenant text.

In one embodiment the connecting body may be formed with a groove complementarily fitting to at least a part of a non-curved portion of said first chain link. The connecting body may thus contribute to holding the first chain link in place, and to absorb forces and secondary forces acting on the chain. This embodiment may be particularly useful in combination with the above-mentioned claw, where the claw and the connecting body in combination may be formed with a continuous groove covering more or less one whole curved end portion and one whole straight portion of said first chain link.

In one embodiment said activation portion may be activatable by being displaced by a second chain link of said chain when said chain is being pulled in the second direction. Upon displacing the activation portion, the locking portion will be moved away from the first chain link as these are mechanically connected.

In one embodiment said first and second chain links may be consecutive chain links of the same orientation, such as standing chain links, connected by an intermediate chain link of another orientation. This embodiment has been shown to give a particularly good load distribution when locking the chain, while at the same time making it practical to disengage said chain locking portion from the first chain link. This implies that the locking function and activation function are provided by different chain links, in this embodiment consecutive chain links of the same orientation.

In one embodiment at least a part of said activation portion may be a curved surface complementarily fitting a curved portion of said second chain link. The chain stopper may thus be activated without significant wear on the second chain link and on the activation portion. As the chain is being pulled in the second direction, the second chain link will gently displace the activation portion, mechanically connected to the locking portion, so as to move the locking portion away from its engagement with the first chain link.

In one embodiment, said chain locking portion and said activation portion, and thus possibly also the connecting body, may be rotatable around an axis substantially perpendicular to the length axis of said chain, implying that said activation portion may be rotatably displaced by the chain upon pulling the chain in the second direction, whereby the chain locking portion may be rotatable out of engagement with said first chain link. The rotation axis may, in one embodiment, be located on the opposite side of the length axis of the chain compared to said chain locking portion. This may be beneficial for facilitating pulling of the chain past the activation portion while lifting the chain locking portion and subsequently for ensuring a reliable automatic locking of the chain in the first direction with little clearance, i.e. a good fit, between the chain locking portion and the chain link being engaged, as will be more clearly understood with reference to the figures and to the appurtenant text. This embodiment may be particularly useful in combination with the embodiment where the first and second chain links are consecutive chain links of the same orientation, implying that the chain stopper, in its locking position, houses/covers two standing chain links and an intermediate laying link. Having a relatively short connection body, while at the same time having the axis of rotation only a short distance, for instance in the range of the bar diameter of the chain links, below the central length axis of the chain ensures a good functionality of the chain stopper where both lifting of the chain locking portion as well as absorption of forces acting on the chain stopper in its locking position are substantially optimized.

It should be noted that even if a rotating embodiment may be favourable in many applications, the disclosure envisions chain stoppers with linearly connected and moving locking portions and activation portions.

In one embodiment the chain locking portion may be adapted to engage said first chain link by means of gravity or at least partially by means of gravity. The chain locking portion may thus engage the first chain link without the need for any biasing means, potentially making the chain stopper robust and reliable. This embodiment may be particularly useful in combination with the embodiment where the chain locking and activation portions are rotatable around an axis substantially parallel to the length axis of the chain. By having the centre of gravity of the chain locking portion side of the rotation axis, the chain locking portion may fall into engagement with a new first chain link after the chain has been pulled in the second direction.

In another embodiment, the chain locking portion may in addition or as an alternative to gravity be adapted to engage the first chain link by means of a biasing means, such as a spring.

In one embodiment the suspension structure may comprise a joint allowing the chain stopper assembly to rotate relative to said support structure. In some areas of use it may be beneficial if the chain stopper is rotatable relative to the support structure, as the chain stopper may follow directional changes, such as declination changes, in the chain due to wind and sea. It may thus be particularly useful if the suspension structure comprises a universal joint, such that the chain stopper may be rotatable in any direction relative to said support structure.

In one embodiment, the chain stopper assembly may comprise a chain guide for keeping at least a portion of the chain in a predetermined position and/or orientation relative to said chain stopper. Depending on the chain locking and activation portions of the chain stopper, it may be useful and even necessary to keep the chain in a fixed position and/or orientation relative to the chain stopper. For instance, if the chain stopping portion is shaped as a claw, it may be useful to ensure that the chain links within the chain stopper are oriented and positioned so as to be engaged by the claw in a predictable manner. The same goes for the activation portion. The chain guide may be provided upstream and/or downstream of said chain stopper. In particular it may also be important that the chain, when it is being pulled in, that is in the second direction, leaves the chain stopper at a predetermined angle. The suspension structure may be provided with a bending shoe downstream of the chain stopper for this reason.

In one embodiment at least a portion of said chain guide may be formed with a cross-shaped cross-section. This will be particularly useful upstream, i.e. on the lower side, of the chain stopper, when the chain is being pulled in, in order to keep standing and laying chain links at substantially 90 degree relative orientation.

In the following identical reference numerals indicate identical or similar features on the drawings. Some of the drawings are shown schematically and simplified, and the drawings are not necessarily to scale. All positional and directional references, such as up, down and upper, lower, etc., refer to the position and directions as shown on the figures. Also, references to standing and laying chain links refer to the links as shown on the figures.

In the following the reference numeral 1 represents a chain stopper according to the first aspect of the disclosure, whereas the reference numeral 10 indicates a chain stopper assembly according to the second aspect of the disclosure.

FIG. 1 shows a chain stopper 1 in a locking position wherein a chain 3 is prevented from being pulled in a first direction D1, but where the chain 3 may be pulled in a second direction D2, as will be described with reference to this and the following figures. The chain stopper 1 is shown connected to a chain guide 5, which is a part of a suspension structure 4 that will be shown and described with reference to FIGS. 8 and 9 below. The chain stopper 1 is rotationally connected to the chain guide 5 at pins 52 protruding from each side of the chain guide 5 around a rotation axis R perpendicular to the length axis of the chain 3. The chain stopper 1 comprises a chain locking portion 11 in the form of a claw and an activation portion 13 in the form of an activation bar, the activation bar extending more or less parallel to the rotation axis R. The claw 11 and the activation bar 13 are connected via a connecting body 12 in form of an arm as described more in detail with reference to FIGS. 2-7 below. The arm 12 is split into side portions 121 towards the activation bar 13 so as to make room for the chain 3 and the chain guide 5 in the chain stopper 1. As can be seen from the figure, the chain guide 5 is formed with portions with a cross-shaped cross-section 53. This cross-section 53 is particularly useful for aligning the links of the chain 3 so that they obtain a predictable positon and orientation in the chain stopper 1. Though not readily visible in the figure, the downstream side of the chain guide 5 is also formed with a cross-shaped cross-section. Upstream and downstream is, as mentioned above, used to describe the entrance and exit sides, respectively, of the chain 3 in the chain stopper 1 when the chain 3 is being pulled in, i.e. in the second direction D2.

FIGS. 2-7 show a series of operating positions wherein the chain 3 is being pulled in the second direction D2. The figures show four different cross-sections of the chain stopper 1 from FIG. 1.

Figure 2:
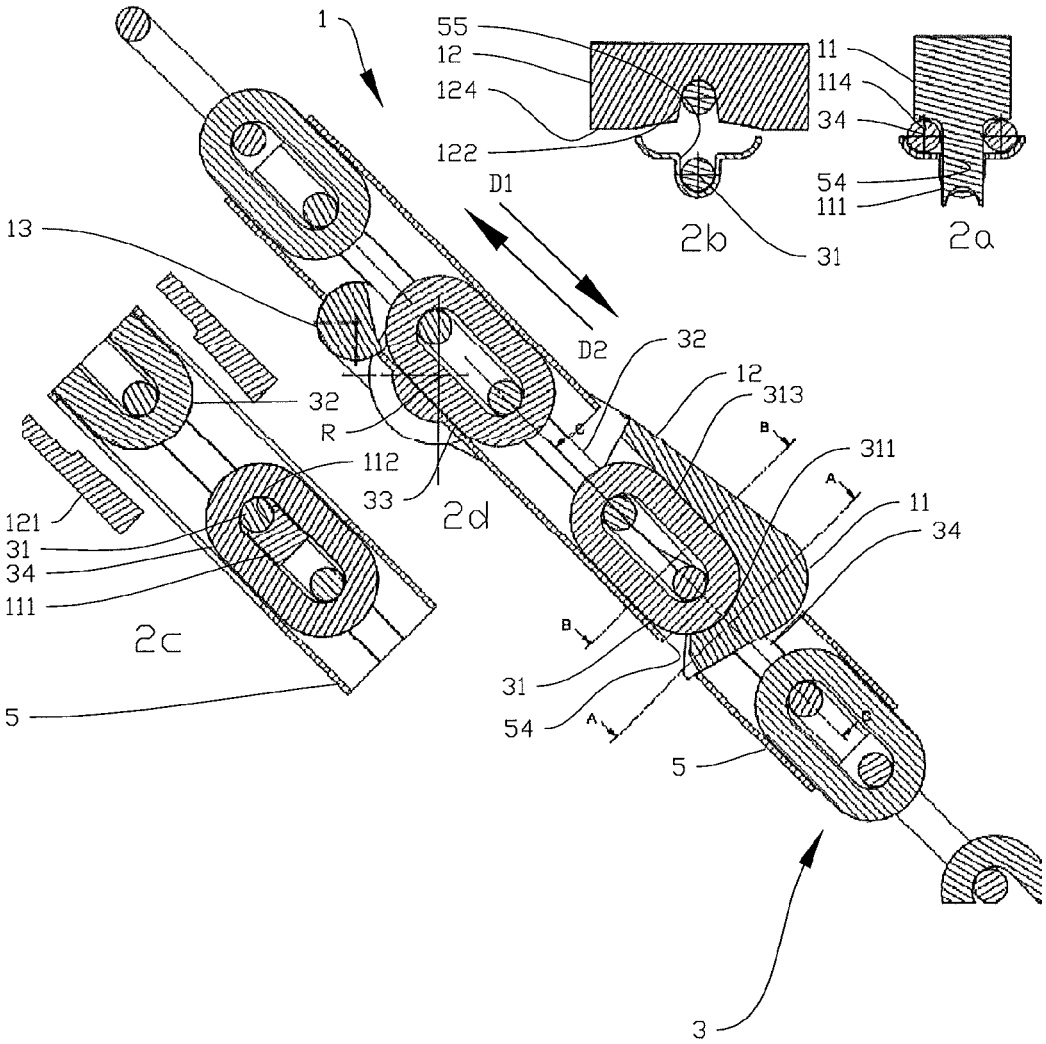
FIGS. 2-7 show, in a side view, different cross-sections of the chain stopper from FIG. 1 in various positions of use.

In FIG. 2, the largest sub-FIG., named 2*d*, shown in the middle of the figure, is a longitudinal cross-section of the chain stopper 1 with chain guide 5 from FIG. 1, with the cross-section taken in a plane symmetrically splitting the chain stopper 1 along the chain 3. The smaller sub-FIGS. 2*a*, 2*b*, and 2*c* are cross-sections taken along the lines, A-A, B-B and C-C, respectively, of the sub-FIG. 2*d*. The chain stopper 1 is shown in the same position as in FIG. 1, while locking the chain 3 and thus preventing it from being pulled in the first direction D1. As can be seen in sub-FIG. 2*d*, the claw 11 and a part of the arm 12 lay around a first link 31 of the chain 3. In the figure, the first link 31 is a standing link. The claw 11 is curved so as to fit complementarily around a curved end portion 311 of the first chain link 31. The curved end portion 311 of the first chain link 31 lays in a groove 112, which is best seen in sub-FIG. 2*c* and in FIG. 10, in the claw 11. The groove 112 continues also into the arm 12, wherein a straight portion 313 of the first chain link 31 lays in a groove 122. The groove 122 in the arm 12 can be seen both in part 2*b* of the figure and in FIG. 10. The claw 11, in this locking position, also extends through a laying link 34 as can been seen in sub-FIGS. 2*d* and 2*a* of the figure. The chain guide 5 is formed with an opening 54 into which the tip 111 of the claw 11 is slightly protruding in this locking position. As best seen in sub-FIG. 2*b*, the chain guide 5 is also formed with a groove 55 extending in the axial direction of the chain 3, complementarily fitting to a second straight portion 313 of the first standing chain link 31. In sum, the space between the arm 12 and the chain guide 5 also forms a cross-shaped cross-section, ensuring that the links of the chain 3 are kept in place also within the chain stopper 1. Laying chain links 32, 34 on either side of the first, standing chain link 31, are held in place by the substantially flat side portions 114, 124 of the claw 11 and arm 12, respectively, facing the chain guide 5, and the chain guide 5 itself.

Sub-figure parts a, b, c and d in FIGS. 3-7 show similar cross-sections as sub-FIGS. 2*a*-2*d* in FIG. 2, but in different operating positions of the chain stopper 1.

Figure 3:
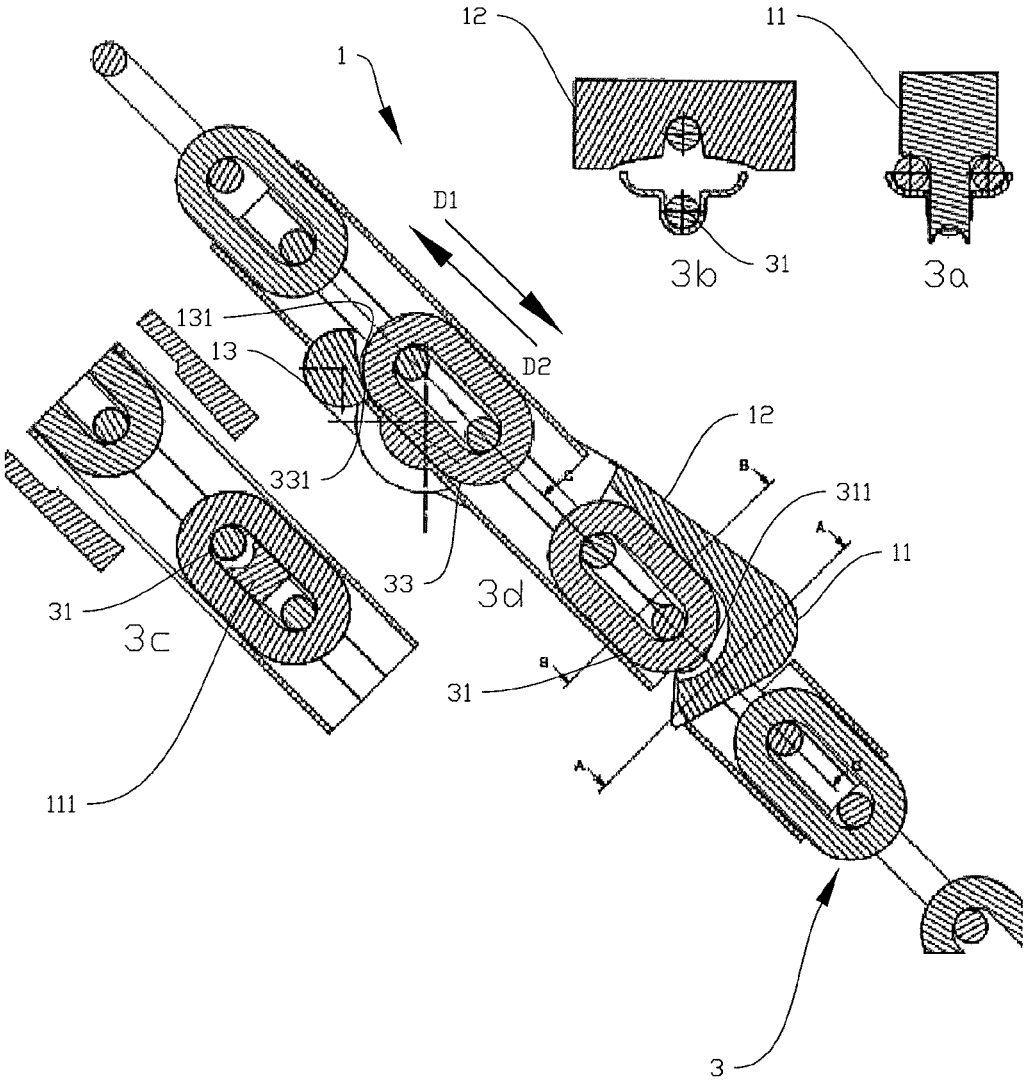

FIG. 3 shows the chain stopper 1 just after starting pulling of the chain 3 in the second direction D2. The pulling is typically initiated by a winch 21 provided on the structure 2 that is being moored, see FIG. 11. In sub-FIG. 3*d*, one can see that the curved end portion 311 of the first, standing chain link 31 has been pulled away from its engagement with the claw 11, whereas a second standing chain link 33, consecutive to the first, standing chain link 31 is coming into engagement with the activation bar 13. A curved surface 131 of the activation bar 13 is coming into engagement with a curved end portion 331 of the second chain link 33. The curved surface 131 is shaped so as to ensure a large contact surface between the activation bar 13 and the second chain link 33, so as to induce little wear on the second chain link 33, while at the same time ensuring displacement and not self-locking of the activation bar 13. A person skilled in the art will know that self-locking of the activation bar is dependent on the friction between the second chain link 33 and the activation bar 13 as well as on any rotational friction of the chain stopper 1. The embodiment shown in the figure prevents self-locking with a good margin, while at the same time providing sufficient forces to rotate the chain stopper 1 so as to lift the claw 11 as will be shown in the following figures. Sub-FIGS. 3*a*, 3*b* and 3*c* show that at this stage, the chain 3 has started moving in the second direction D2 while the claw 11, arm 12 and activation bar 13 are still in their locking positions as shown in the two previous figures.

Figure 4:
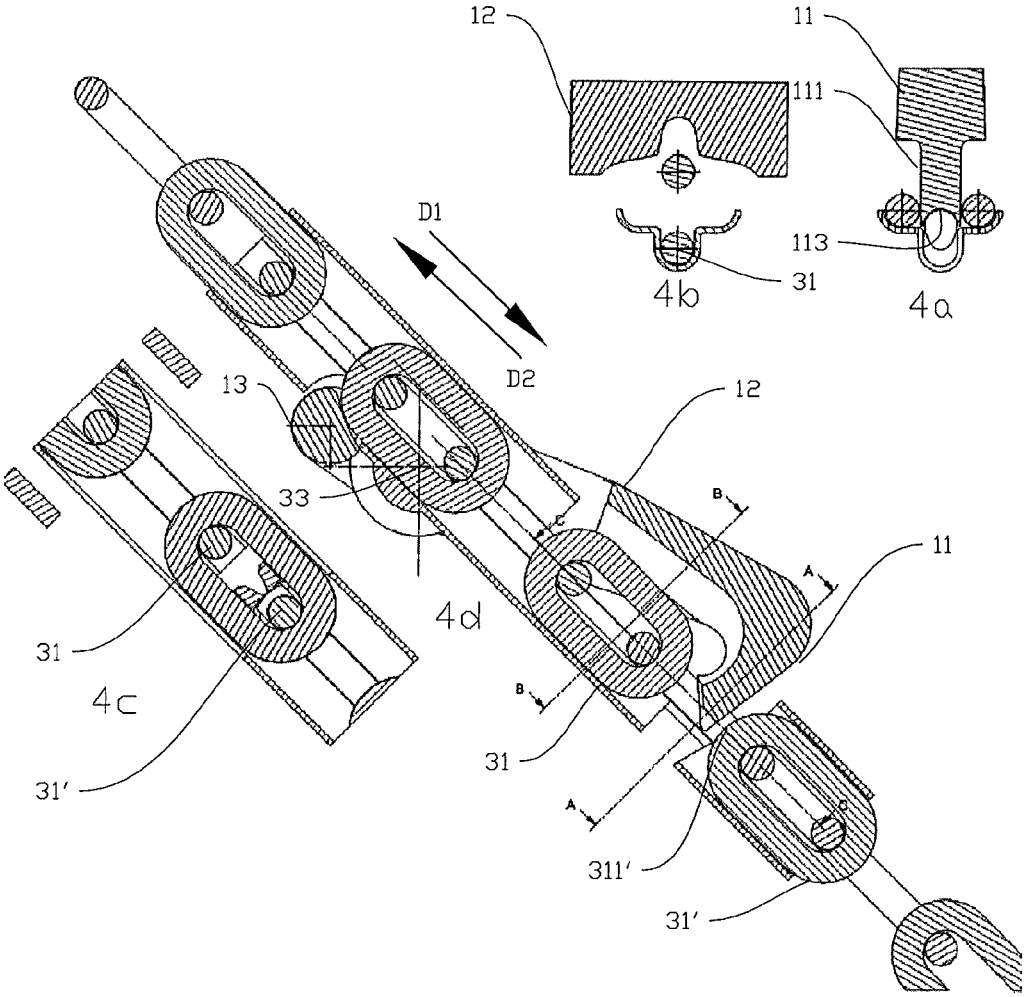
Figure 5:
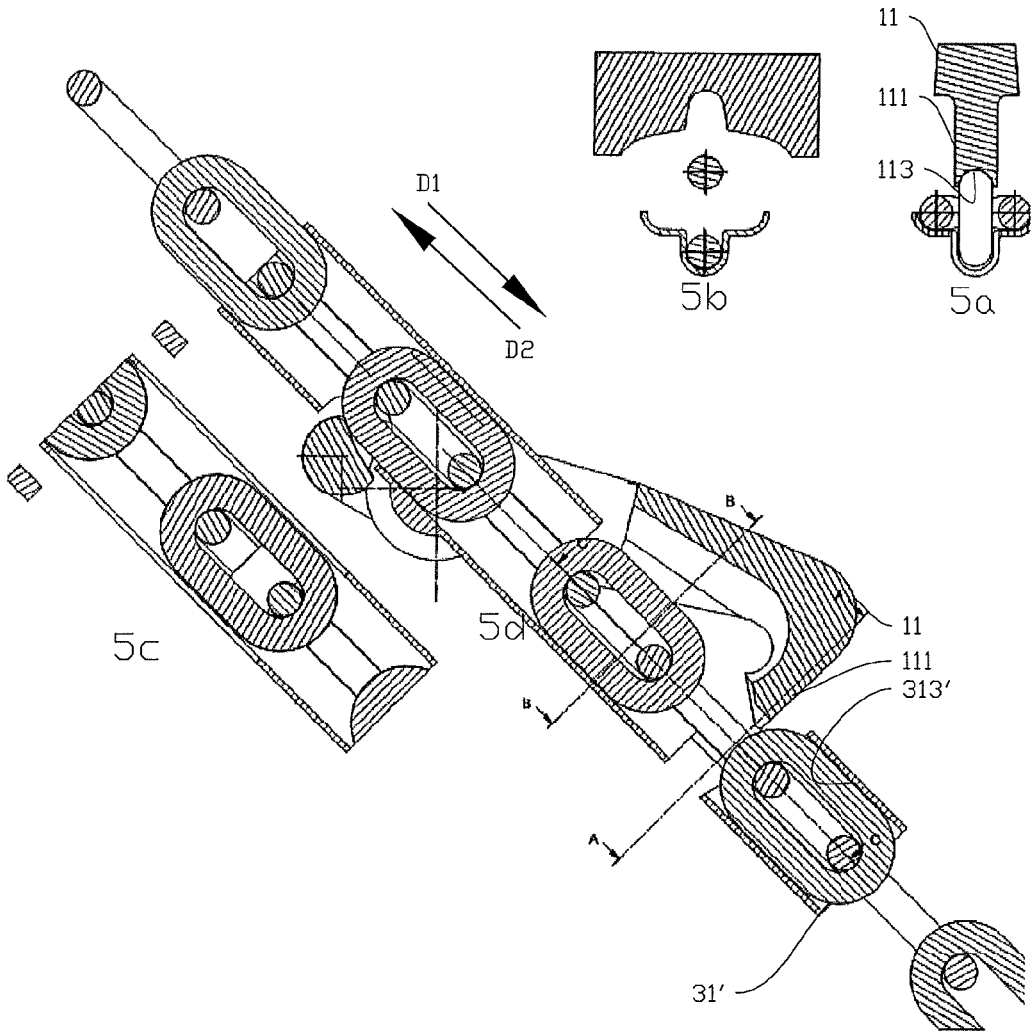
Figure 6:
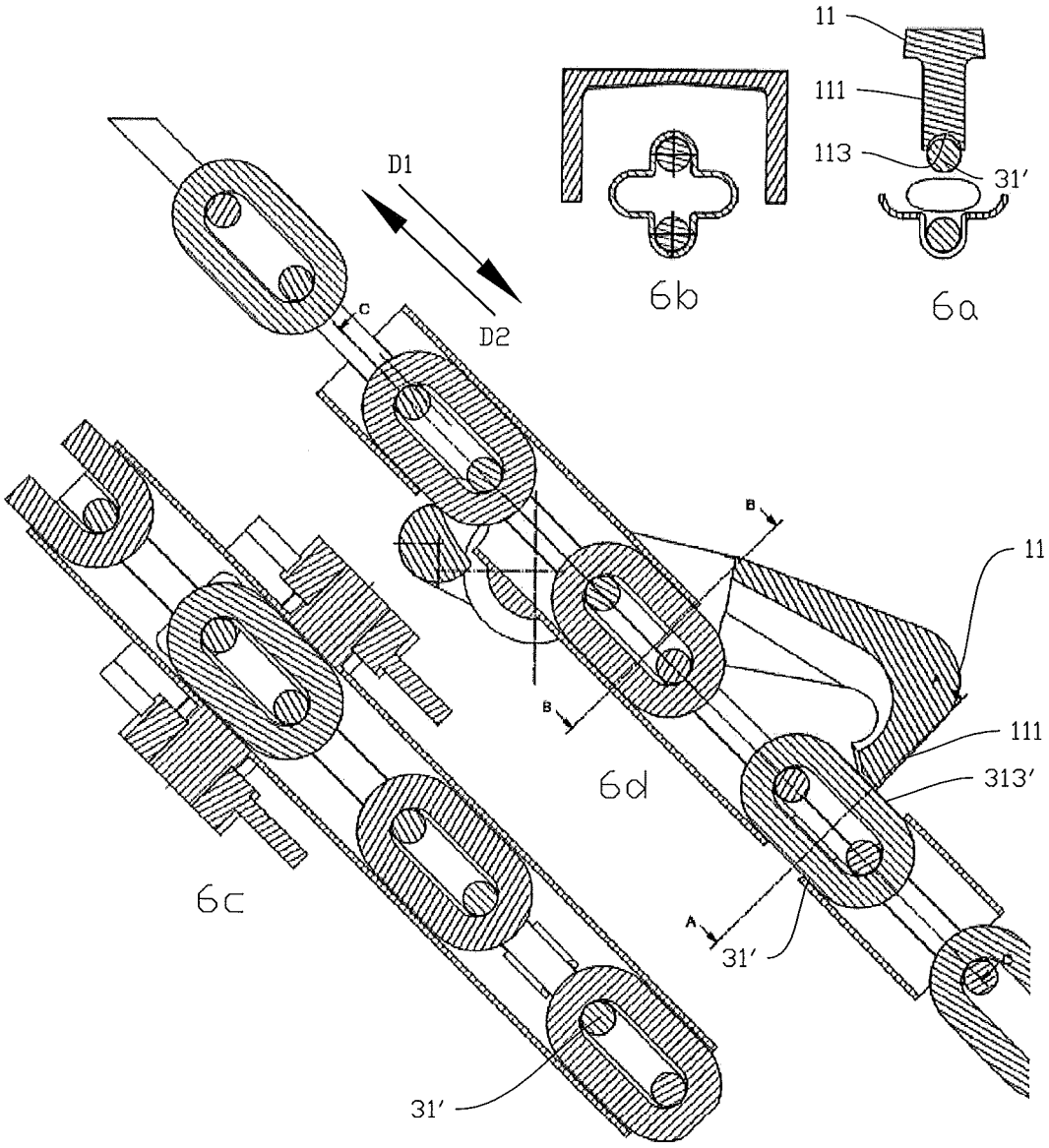

In FIG. 4 it can be clearly seen that the activation bar 13 has started to become slightly displaced by the second chain link 33, as the chain is moving in the second direction D2. The displacement causes the arm 12 to start rotating counter clockwise around the rotational axis R, thus resulting in a lifting of the claw 11 away from the first chain link 31. At the same time, a curved end portion 311' of a next standing chain link 31' has reached the position of the claw 11. The claw 11 has been lifted sufficiently high so that the next standing chain link 31' may pass under the claw 11 as the chain 3 is being pulled in the second direction D2. The tip 111 of the claw 11 is provided with a recess 113 for allowing links of the chain 3 to glide therethrough, whereby the claw 11 may be lifted a distance shorter than the height of a standing chain link, while still allowing the links of the chain 3 to pass thereunder. The tip 111 of the claw 11 is lifted without coming into contact with the next standing link 31', while subsequently a straight portion 313' of the next link 31' slides under the recess 113 of tip 111 of the claw 11 as the chain 3 is pulled further in the second direction D2. In a not shown position of the sequence, between the positions shown in FIGS. 5 and 6, the claw 11 will be lifted completely off the next standing chain link 31'. In the position shown in FIG. 6 there is a small clearance between the tip of the claw 111 and the next standing chain link 31', as can be best seen in sub-FIG. 6*a*, before the tip of the claw 111 falls down on the a downstream part of the straight portion 313' of the next standing link 31' in a not shown position between the positions shown in FIGS. 6 and 7.

Figure 7:
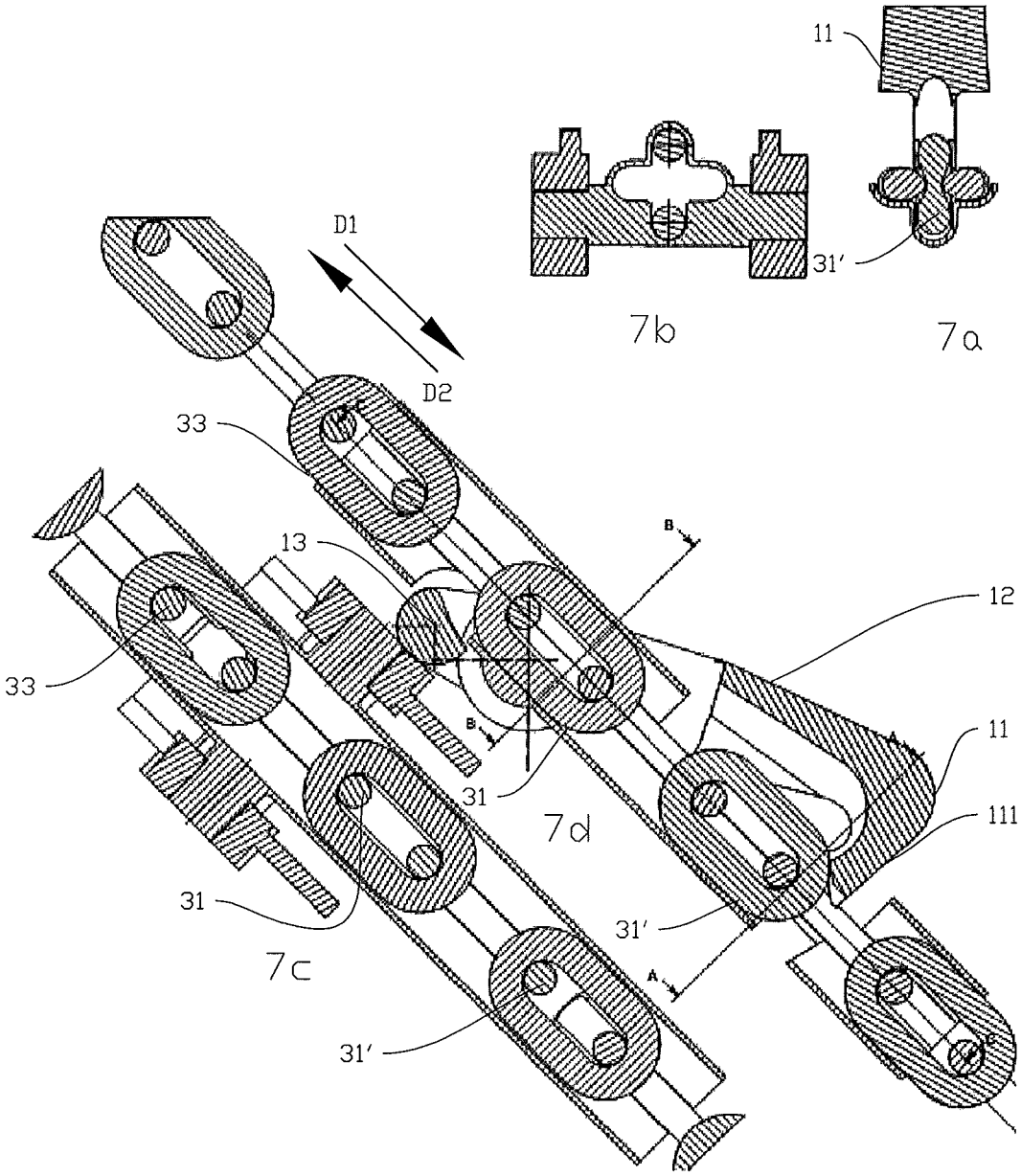

In FIG. 7 it can be seen that the whole second chain link 33 has glided over the activation bar 13. As the centre of gravity of the chain stopper 1 is on the claw side of the rotational axis R, gravity will attempt to rotate the arm 12, and thus the claw 11 and the activation bar 13, clockwise back into the initial position shown in FIGS. 1-3. At first, the arm 12 will be prevented from rotating as the tip 111 of the claw 11 is still being supported by the next standing chain link 31'. This position is not shown in this figure. Subsequently, when the next standing chain link 31' has passed under the tip 111 of the claw 11, the arm 12 will start to rotate clockwise, as shown in the figure, just before the claw 11 falls back into its locking position as shown in FIG. 2, whereby the sequence has been completed once, and the next standing chain link 31' has replaced the first chain link 31 and the first chain link 31 has replaced the second chain link 33. In an alternative, not shown embodiment the claw 11 would not have to be lifted completely off the next standing chain link 31' when lifting the claw 11 by pulling the chain 3 in the second direction D2. An upper part of the upstream curved end portion 311' of the next standing chain link 31' could meet the tip 111 of the claw 11 so as to push the claw 11 a last bit so that the next standing chain link 31' can glide under the tip 111.

In the embodiment of the chain stopper 1 shown with reference to FIGS. 1-8 above, it has been found that a certain geometrical design of the chain stopper 1 may be beneficial for the operation. If the links of the chain 3 are provided with bar diameter d, not shown in any figure, the distance from the rotational axis R to the contact zone between the claw 11 and the first chain link 31 is approximately 10 times d. Further the distance from the rotational axis R to the cross-sectional centre of the activation bar is approximately 3 times d. The distance from the rotational axis R to the length axis of the chain 3 is approximately d, implying that the rotational axis R is located d below the length axis of the chain 3. The fact that the rotational axis R is located a short distance below the length axis of the chain 3 implies ensures that both a good locking function and a good activation function while allowing the chain 3 to pass smoothly over the activation bar 13. A longer arm 12 would also be possible so that the chain stopper 1 holds more than two standing links 31, 33 therein. In one embodiment, there could be a not shown standing link between the first chain link 31 and the second chain link 33 so that the chain stopper 1 covers three standing links. Upon rotating the arm 12, the claw 11 would then, with a longer arm 12, move a smaller distance along the length axis of the chain 3. The projection of the movement of claw 11 onto the length axis of the chain 3 is shorter for a longer arm 12, as the arm 12 will have to move a smaller angle in order to be lifted the same distance perpendicularly to the length axis of the chain 3 due to the reduced curvature of the circle along which the claw 11 is moving. This could potentially imply that the claw 11 would have to be formed with a curved portion covering a smaller sector or that the claw 11 would have to made less solid and therefore would be less adapted to give support for the curved end portion 311 of the first link 31 and/or to handle the forces acting on the claw 11 from the chain 3. One important advantage of a relatively short arm 12, as shown in FIGS. 1-7, compared to a longer arm, is that with the relatively short arm 12, any movement of the chain stopper 1 resulting from the chain's 3 interaction with the activation bar 13, is less amplified at the claw's 11 end of the chain stopper 1, resulting in better control of the position of the claw 11 relative to the position of the links of the chain 3. It should be emphasized that this particular geometrical arrangement is only one out of many potential geometrical arrangements that may be employed.

Figure 8:
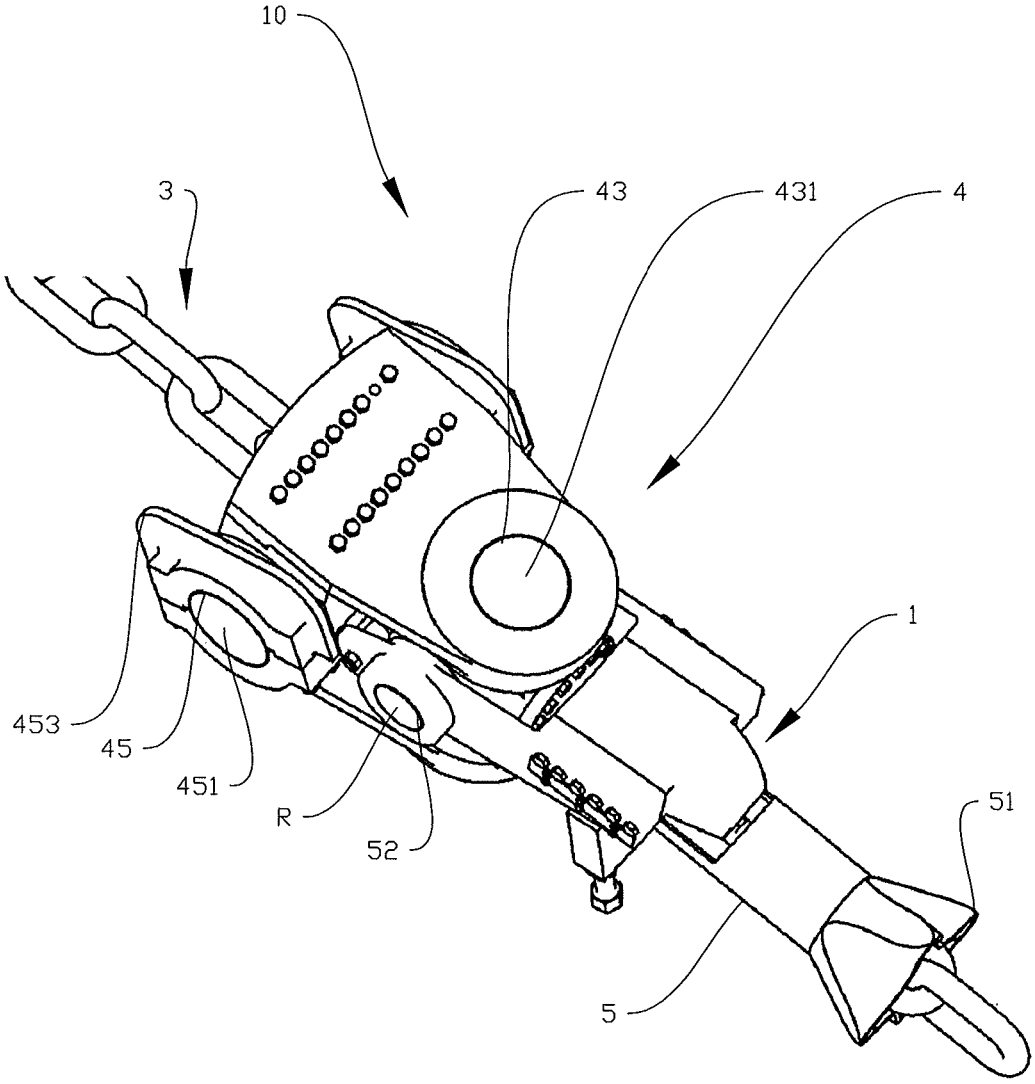
FIG. 8 shows, in a perspective view, a chain stopper assembly according to the present disclosure.

FIG. 8 shows a chain stopper assembly 10 according to the second aspect of the disclosure. The chain stopper assembly 10 comprises a suspension structure 4 housing the chain stopper 1 described above. The suspension structure 4 comprises a first rotation joint 43 allowing the chain stopper 1 and the chain guide 5, here also provided with a bell mouth 51, to rotate around an axis 431 perpendicular to both the rotation axis R of the chain stopper 1 and to the length axis of the chain 3. The chain stopper assembly 10 is further provided with pins 45 for connecting the chain stopper assembly 10 to a support structure 2, not shown in this figure, by means of bushings 453, whereby the chain stopper assembly 10 is also rotatable relative to the not shown support structure 2 around an axis 451, effectively making the chain stopper assembly 10 function as a universal joint suspension for the chain stopper 1. In an alternative embodiment, the pins 45 may be integrated with the pins 52 around which the chain stopper 1 itself is rotatable as described above. The latter embodiment would provide for a shorter but wider, relative to the length axis of the chain 3, chain stopper assembly 10. The bushings 453 will typically be welded to the support structure.

Figure 9:
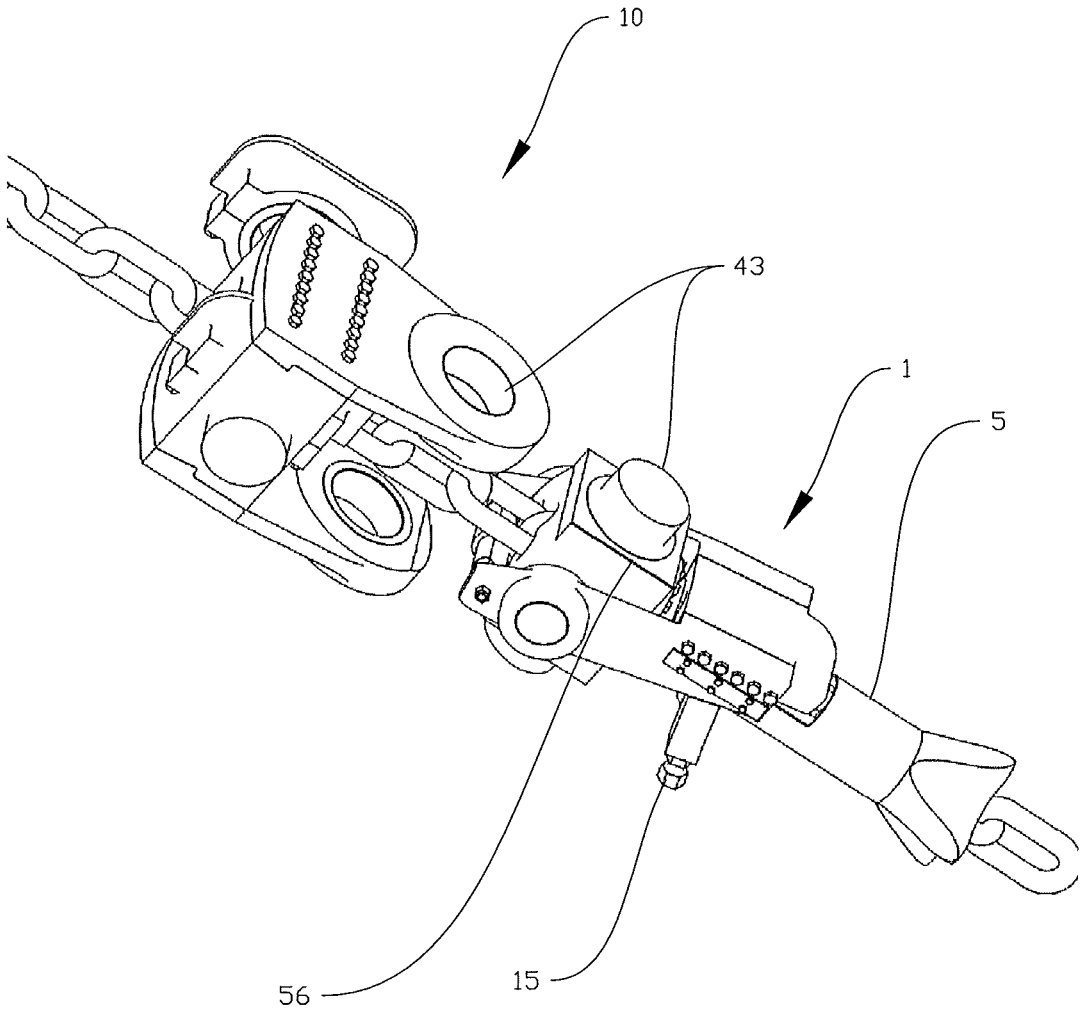
FIG. 9 shows, in an exploded and different perspective view, the chain stopper assembly from FIG. 8.

FIG. 9 shows an exploded view of the chain stopper assembly 10 from FIG. 8. One of the bushings 453 has been removed for the overview. As can be seen from the figure, the chain guide 5 has been reinforced by means of a centre joint housing 56 acting both as a part of the chain guide 5 as well as a rotation centre for the chain stopper 1 and for the first rotation joint 43. The chain stopper assembly 10 is further provided with a connection portion 15, engageable by a ROV or the like, in the rare case where the chain 3 has to be de-tensioned or replaced.

Figure 10:
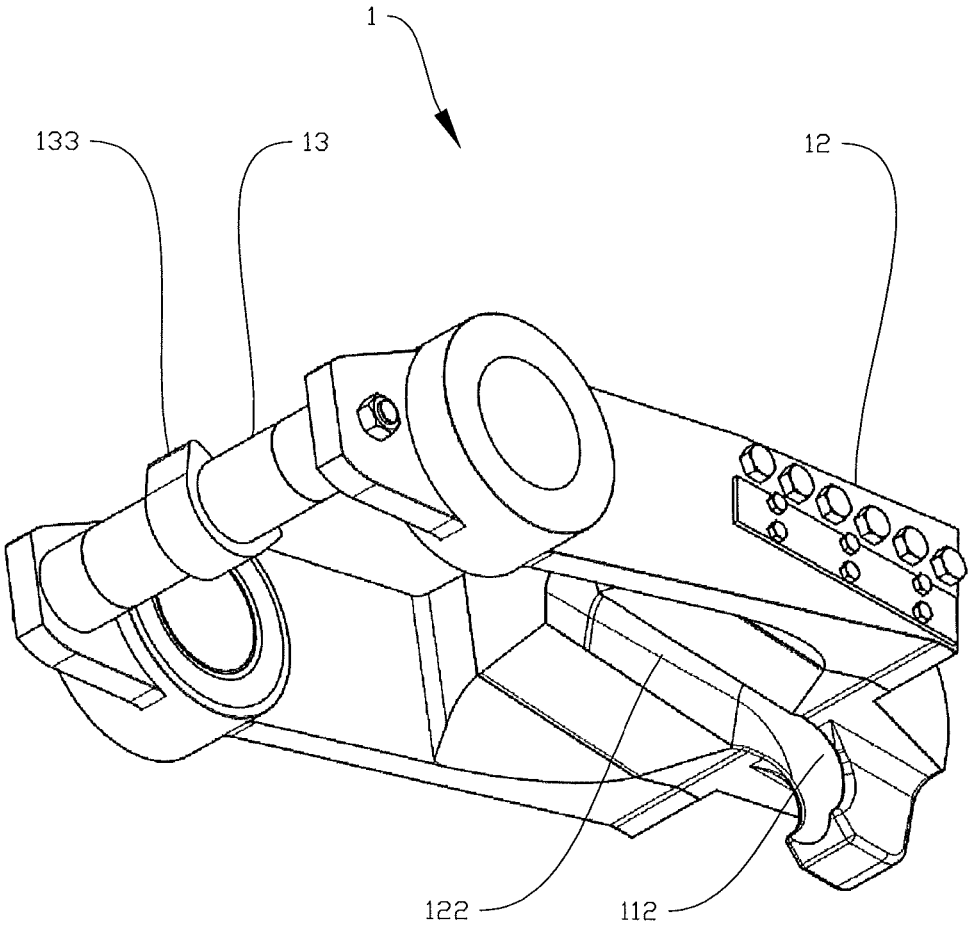
FIG. 10 shows, in a perspective view, the chain stopper of the chain stopper assembly of FIGS. 8 and 9.

FIG. 10 shows the chain stopper 1 from the chain stopper assembly 10 of FIGS. 8 and 9. The chain stopper 1 is quite similar to the one shown in FIGS. 1-7, but with a reinforced engagement part 133 of the activation bar 13. The figure also clearly shows the continuous groove 112, 122 extending from the claw 11 to the arm 12 shaped so as to complementarily fit to and cover approximately one half of the circumference of the first chain link 31, not shown in this figure.

Figure 11:
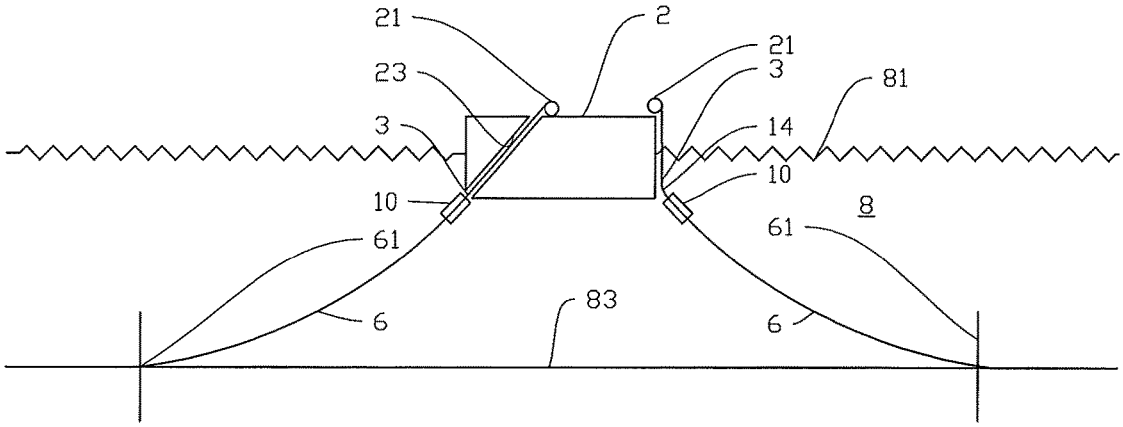
FIG. 11 shows, in a schematic, simplified side view, two possible uses of a chain stopper assembly according to the present disclosure.

FIG. 11 shows, schematically and simplified, possible uses of chain stopper assemblies 10 according to the present disclosure. A structure 2 is floating in the sea 8, partially submerged below sea level 81. The structure 8 is moored to the sea bed 83 by means of mooring lines 6 connected to anchors 61 on the sea bed 83. Two alternative uses of chain stopper assemblies 10 are shown in the figure. In the version on the right hand side, the chain 3 runs outside the hull of the structure 2 from the chain stopper assembly 10 and up to a winch 21, as is common in semi-submersible floating structures. The chain guide part 5 of the suspension structure 4, which is not shown in detail in this figure, is provided with a bending shoe 14 to handle the bending of the chain 3 downstream of the chain stopper assembly 10, from the chain stopper assembly 10 towards the winch 21. On the left hand side of the figure, a version where the chain 3 is extending through the hull, in a hawser pipe 23 or the like, of the structure 2 is shown. The chain 3 extends substantially in the same direction from the winch 21 through the chain stopper assembly 10, to the mooring line 6 and down to the anchor 61. The chain stopper assembly 10 with universal joint as shown in FIGS. 8 and 9 will be particularly useful for this application. Though not specifically shown on the figure, the chain stopper assemblies 10 are connected to the floating structure 2, the floating structure 2 thus acting as a support structure for the suspension structure 4, and thus for the chain stopper 1 itself. It should be noted that even if the requirements of the chain stopper assembly 10 in which the chain stopper 1 is suspended may differ between different applications, the chain stopper 1 itself may be the same.

It should be noted that the above-mentioned exemplary embodiments illustrate rather than limit the disclosure, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The invention claimed is:

1. Chain stopper being connectable to a support structure and comprising:

a chain locking portion for automatically engaging a first chain link of a chain so as to prevent the chain from being pulled in a first direction;

characterised in that said chain stopper further comprises:

an activation portion provided at a distance from said chain locking portion and connected to said chain locking portion, said activation portion, upon pulling said chain in a second direction, being adapted to be engaged by said chain so as to disengage said chain locking portion from said first chain link by rotation of the connecting body around an axis substantially perpendicular to the length axis of said chain, allowing said chain to be pulled in said second direction, wherein said chain locking portion includes a claw, the claw being curved so as to fit complementarily around at least a curved end portion of said first chain link when preventing the chain from being pulled in the first direction.

2. Chain stopper according to claim 1, wherein said claw is adapted to substantially cover said curved end portion of said first chain link.

3. Chain stopper according to claim 2, wherein a tip of said claw is formed with a recess allowing a chain link to glide therethrough.

4. Chain stopper according to claim 1, wherein the connection body is formed with a groove complementarily fitting to at least a part of a non-curved portion of said first chain link.

5. Chain stopper according to claim 1, wherein said activation portion is activatable by being displaced by a second chain link of said chain when said chain is being pulled in said second direction.

6. Chain stopper according to claim 5, wherein said first chain link and said second chain link are consecutive chain links of the same orientation.

7. Chain stopper according to claim 5, wherein at least a part of said activation portion is formed as a curved surface complementarily fitting a curved portion of said second chain link.

8. Chain stopper according to claim 1, wherein said rotation axis is located on the opposite side of the length axis of said chain compared to the chain locking portion.

9. Chain stopper according to claim 1, wherein said chain locking portion is adapted to automatically engage said first chain link at least partially by means of gravity.

10. Chain stopper assembly comprising:

a chain stopper being connectable to a support structure, the chain stopper comprising:

a chain locking portion for automatically engaging a first chain link of a chain so as to prevent the chain from being pulled in a first direction, said chain locking portion including a claw, the claw being curved so as to lit complementarily around at least a curved end portion of said first chain link when preventing the chain from being mulled in the first direction;

an activation portion provided at a distance from said chain locking portion and connected to said chain locking portion via a connecting body, said activation portion, upon pulling said chain in a second direction, being adapted to be engaged by said chain so as to disengage said chain locking portion from said first chain link by rotation of the connecting body around an axis substantially perpendicular to the length axis of said chain, allowing said chain to be pulled in said second direction;

the chain stopper assembly further comprising a suspension structure connected to the chain stopper.

11. Chain stopper assembly according to claim 10, wherein the suspension structure comprises a joint allowing the chain stopper assembly to rotate relative to said support structure.

12. Chain stopper assembly according to claim 10, wherein the suspension structure comprises a universal joint allowing the chain stopper to rotate in any direction relative to said support structure.

13. Chain stopper assembly according to claim 10, wherein the suspension structure further comprises a chain guide for keeping at least a portion of the chain in a predetermined position and/or orientation relative to said chain locking portion.

14. Chain stopper assembly according to claim 13, wherein at least a portion of said chain guide is formed with a cross-shaped cross-section.

* * * * *